United States Patent [19]

Mayer

[11] Patent Number: 4,537,045

[45] Date of Patent: Aug. 27, 1985

[54] COMBINATION REFRIGERANT RECEIVER, ACCUMULATOR AND HEAT EXCHANGER

[75] Inventor: Donald K. Mayer, Bloomington, Minn.

[73] Assignee: Westinghouse Electric Corp., Pittsburgh, Pa.

[21] Appl. No.: 679,512

[22] Filed: Dec. 7, 1984

[51] Int. Cl.[3] ..... F25B 43/00

[52] U.S. Cl. ..... 62/503; 62/509; 62/513

[58] Field of Search ..... 62/503, 513, 113, 509

[56] References Cited

U.S. PATENT DOCUMENTS

| | | | |
|---|---|---|---|
| 2,461,342 | 2/1949 | Obreiter, Jr. | 62/503 |
| 3,084,523 | 4/1963 | Bottum et al. | 62/503 |
| 3,621,673 | 11/1971 | Foust | 62/503 |
| 3,651,657 | 3/1972 | Bottum | 62/503 |
| 4,488,413 | 12/1984 | Bottum | 62/503 |

*Primary Examiner*—Ronald C. Capossela
*Attorney, Agent, or Firm*—E. C. Arenz

[57] ABSTRACT

A combined refrigerant receiver, suction gas accumulator, and heat exchanger is provided and is particularly useful in connection with a transport refrigeration unit, and includes an internal concentrically disposed receiver 46 in the upper portion of an accumulator shell 40, the disposition providing an annular space 48 between the receiver and accumulator shell, in which is located a helically wound finned tube heat exchanger 56 which carries warm liquid refrigerant from the receiver to an outlet of the shell connected to an evaporator, with cold suction gas entering the shell at 52 and passing over the external fins 60 on the heat exchanger to exit the shell at 66.

8 Claims, 2 Drawing Figures

COMBINATION REFRIGERANT RECEIVER, ACCUMULATOR AND HEAT EXCHANGER

BACKGROUND OF THE INVENTION

This invention pertains to the art of refrigeration and, in particular, to an arrangement promoting refrigerating efficiency through the provision of a structure which combines in a particular way a refrigerant liquid receiver, a refrigerant suction gas accumulator, and a liquid-suction heat exchanger.

In a transport refrigeration system, such as that provided by the assignee of this invention, and as somewhat schematically shown in the prior art FIG. 1, liquid refrigerant passes through the outlet of the condensing coil 10 to a receiver tank 12. The liquid refrigerant then passes through line 14 to a liquid refrigerant, suction gas heat exchanger 16 en route to expansion valve 18 and into the inlet of the evaporator coil 20. The suction gas leaving the evaporator coil is routed through line 22 to heat exchanger 16 and from there to line 24 to an accumulator tank 26 which, in its conventional form, includes the U-shaped dip tube 28 through which the vaporous refrigerant is drawn into line 30 which connects to the suction inlet of the compressor 32.

As may be seen in FIG. 1, the evaporator 20 and heat exchanger 16 are located within the confines of the conditioned space such as the trailer 34, while both the condenser 10 and the accumulator 26 are located in a cabinet 36 exterior of the trailer, and subject to ambient temperatures. Typically, the temperature within the cabinet 36, and to which the receiver 12 is subjected, will be even higher than the ambient temperature outside of the cabinet since the heat from the condenser 10 and from the radiator for the engine driving the compressor 32 add to the heat from the outdoors. Because of the relatively high ambient temperature in the vicinity of the receiver 12 and the related piping 14, the subcooled refrigerant liquid leaving the condenser coil is reheated. Thus the cooling capacity of the system is diminished to the extent that the liquid refrigerant is heated by the warm ambient surroundings. The heat exchanger 16 is intended to reduce this problem by transferring heat from the warm liquid refrigerant to the cooler vaporous refrigerant.

In passing from the heat exchanger 16 to the compressor 32, the suction gas is routed through the accumulator tank 26, as previously noted. The accumulator serves its normal function as a reservoir for liquid refrigerant and to prevent the passage of any significant amount of liquid refrigerant to the compressor. In the transport refrigerant environment, the accumulator also functions in the fashion of an evaporator when the reversible unit is operating in a heating mode, as distinct from a cooling mode. To have the accumulator function as an evaporator during the heating mode, means is provided to deliver heat to the lower portion of the accumulator, and this may be accomplished such as by providing tubes 38 coiled around the lower portion of the accumulator and connected to the engine coolant circuit.

The cooling capacity and efficiency of the system in the prior art of FIG. 1 also suffers to a degree from heating of the accumulator 26 by warm ambient temperatures in the cabinet 36. The warm ambient causes the refrigerant vapor to be superheated to a temperature well above the temperature of saturated vapor. To the degree that this happens, the system is penalized.

As a typical example of how the system is penalized with relatively high outdoor air temperatures, typical examples of temperature values will be given. If the outside air temperature is about 100° F. (38° C.), the air temperature around the receiver may be significantly hotter, such as 135° F. (57° C.) because of heat given off by the engine radiator and the condenser. The hot refrigerant liquid received by the receiver 12 may be in the order of 115° F. (46° C.) so the refrigerant in the receiver and in its passage through line 14 to heat exchanger 16 is heated, which is a penalty to the system.

Under the temperature conditions assumed, the vaporous refrigerant leaving the evaporator 20 and passing to the heat exchanger may be, say, 10° F. (−12° C.) where it is perhaps heated to, say, 65° F. (18° C.), at which temperature it passes to the accumulator 26. With the relatively high ambient of, say, 135° F. (57° C.), the refrigerant vapor may be heated up to, say, 90° F. (32° C.) in the accumulator and in its passage to the compressor. Thus the vapor is highly superheated under these conditions, well beyond the degree of superheat leaving the liquid-suction heat exchanger, and this high superheat also penalizes the system.

The compressor cooling efficiency in this prior art system is also penalized by the suction line restriction that occurs in the U-tube 28 within the accumulator tank 26. This suction restriction is due to the combined effect of the entrance loss at the U-tube inlet and the partial internal obstruction by the liquid lubricating oil which tends to collect in the bottom of the U-tube.

A further problem with the prior art system relates to the return of lubricating oil to the compressor crankcase. The oil aerosol that returns to the compressor 32 entrained with the suction vapor is expected to separate within the compressor inlet passages and drain back to the compressor crankcase. Because of relatively high vapor transport velocities within the compressor inlet passages, an undesirable proportion of this returned oil remains entrained in the vapor and is recycled through the entire system. This penalizes the total performance by reduced compressor pumping efficiency and by reduced heat transfer within the condenser 10 and evaporator 20 coils.

It is the aim of this invention to mitigate the problems noted through the provision of a structural arrangement of the receiver, accumulator, and heat exchanger in combination.

SUMMARY OF THE INVENTION

In accordance with the invention, a combined liquid refrigerant receiver, refrigerant suction gas accumulator, and liquid-suction heat exchanger is provided which includes an outer cylindrical shell serving as the accumulator and having a refrigerant gas inlet and a refrigerant gas outlet, an inner cylindrical casing, concentrically disposed in the shell to provide an annular space therebetween, and serving as the liquid refrigerant receiver, the receiver having an inlet connected to the condenser outlet, and an outlet located internally of the shell, and a heat exchanger located in the annular space, having an inlet connected to the receiver outlet and an outlet in communication with a refrigerant evaporator inlet through an expansion device, and serving to exchange heat between liquid passing therethrough and gas passing thereover.

Additional aspects of the invention will be provided in the following material.

DESCRIPTION OF THE PREFERRED EMBODIMENT

Figure 2:
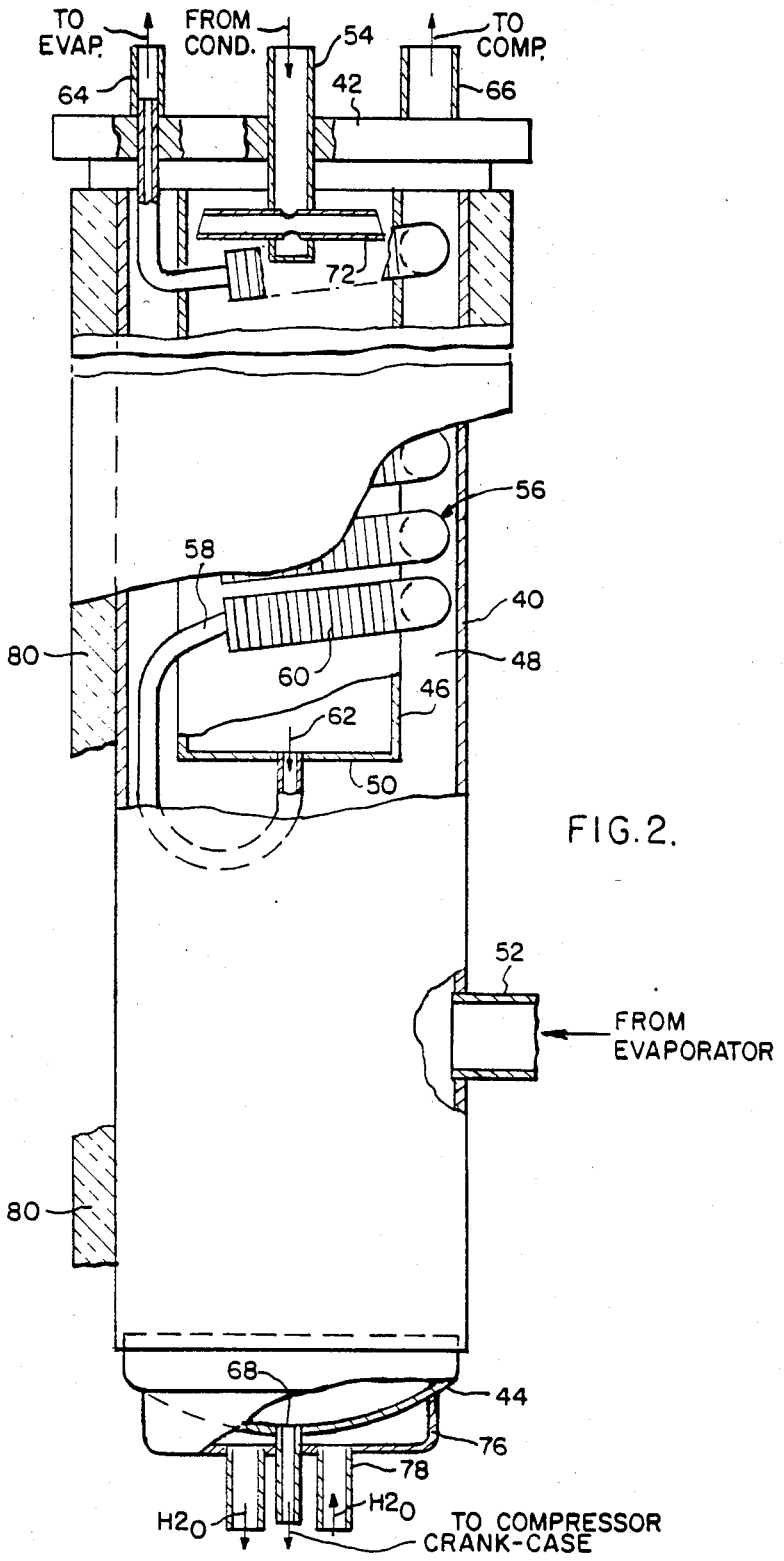
FIG. 2 is a side elevation, partly broken and partly in section, illustrating one form of the combined receiver, accumulator, and heat exchanger for carrying out the invention.

Referring to FIG. 2, the device of the invention includes an outer cylindrical shell 40 having a top wall 42 and a bottom wall 44 and serving as the refrigerant accumulator. This accumulator is disposed in a generally upright position.

An inner cylindrical casing 46 is concentrically disposed in the upper part of the shell 40 to provide an annular space 48 between the casing and shell, the top of the casing being common with the top 42 of the shell, and the bottom end 50 of the casing being located at least as high and preferably above the level of the tube 52 which delivers vaporous refrigerant from the evaporator to the accumulator. This casing with its top and bottom functions as a liquid refrigerant receiver which receives hot refrigerant liquid through tube 54 connected to the outlet of the refrigerant condenser 10.

A heat exchanger generally designated 56 is located in at least a part of the annular space and may take the form of a tube 58 upon which a continuous fin 60 is spirally wrapped. This heat exchanger 56 is itself helically wound around the receiver 46 with one end of the tube 58 being connected to the outlet 62 of the receiver, and the other end of the tube exiting the top 42 at outlet fitting 64.

Figure 1:
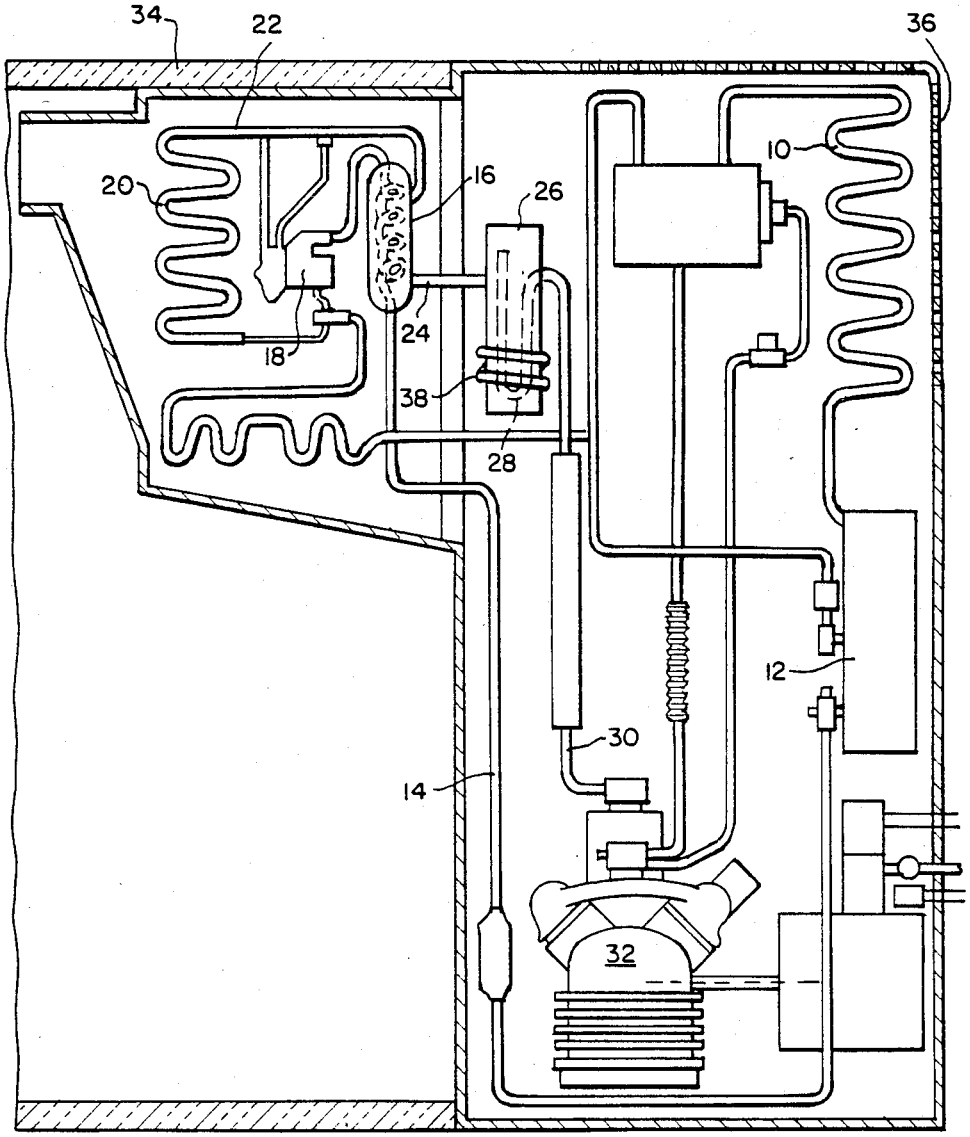
PRIOR ART FIG. 1.
FIG. 1 is a schematic view of the main parts of a transportation refrigeration system which is typical in the prior art.

It will be noted in FIG. 2 that the suction gas outlet 66 from the accumulator is in the top portion thereof so that the fin tube heat exchanger 56 is interposed in the annular space path, which vaporous refrigerant entering the accumulator through the tube 52 must traverse to exit the accumulator at 66. One advantage of this particular arrangement is that the heat exchanger fins will also function as an aerosol collector to reduce refrigerant liquid carryover. Further, any liquid refrigerant droplets collected on the heat exchanger fins will further improve the cooling of the refrigerant liquid within the tube 58 upon a subsequent evaporation of the droplets. The arrangement of the fin tubing 56 of the heat exchanger occupying, in a diametrical sense, the extent of the annular space requires that the vaporous refrigerant must pass in intimate contact with the fins. In the commercial type of heat exchanger 16 (FIG. 1) currently used by the assignee of this application, the finned tubing of the heat exchanger is wound in a helix which results in a central core passage inside the helix. As a result, there is some tendency for the vaporous refrigerant to take this least resistance path between the inlet and outlets for the vaporous refrigerant. In the arrangement shown in FIG. 2, the receiver tank occupies any such open core space. Heat exchanger performance is also enhanced because of the larger helix diameter permitted with the arrangement according to the invention. Because of the larger circumferential length of the annular coils of the heat exchanger, a longer length of fin tubing is possible. Also the larger coil diameter can result in some improved liquid film coefficient cooling within the fin tubing. The refrigerant vapor, after being heated by the heat exchanger 56, then exits from the top of the accumulator tank 42, through the vapor outlet tube 66, through a suction line such as 30 in FIG. 1 to the vapor inlet of the compressor 32 in FIG. 1.

In contrast with the prior art accumulator tank, in the current preferred arrangement this accumulator does not rely on oil reentrainment with a U-tube to return lubricating oil from the bottom of the accumulator tank to the compressor. The oil, which separates from the refrigerant vapor stream after entering the relatively tranquil accumulator space below the receiver, discharges through the outlet 68 in the bottom 44 of the accumulator tank and then into a line 70 connected to the compressor crankcase, in the manner taught in my U.S. Pat. No. 4,249,389, hereby incorporated by reference. This arrangement increases the cooling capacity of the entire system by the combined benefits of less compressor suction restriction and less recirculating oil.

While the preferred oil return arrangement is that of my noted patent, an oil return arrangement could alternatively be provided in which a U-tube is external to the accumulator. In this case (not shown), the oil from the bottom of the accumulator would be piped to the bottom of the U-tube occupying a space alongside the accumulator, and the suction gas leaving the accumulator through tube 66 would pass into the upstream end of the U-tube. Such an arrangement should also include a bleed tube (not shown) extending from the upper part of the tank and the downstream leg of the U-tube.

In the top region of the receiver tank, where the liquid inlet fitting 54 admits warm liquid from the condenser coil into the receiver tank, a transversely positioned conduit 72 causes this warm liquid to impinge against the inside surface of the receiver tank wall 46, which is cooled by the refrigerant vapor from the evaporator. The scarfed or beveled ends 74 of this transverse conduit 72 provide the desired liquid stream impingement for both low and high flow rates, without excessive flow restriction.

As is conventionally known, a source of external heat is typically provided to the lower outside part of the accumulator to boil any liquid refrigerant collected in the bottom of the accumulator tank as well as to provide a source of heat to the accumulator tank when it is functioning as an evaporator in the heating mode of operation of the system. To this end, the external source of heat may take the form of a cap 76 at the bottom of the accumulator tank and supplied typically through pipe 78 by the coolant of the engine driving the compressor. Alternatively, the engine coolant could be circulated through a tube wrapped around the lower portion of the accumulator, or in certain instances the external heat may be supplied by electric resistance heaters.

Thermal insulation means 80 in the form of a blanket encompassing at least the major portions of the side walls of the tank and bottom wall serves the function of preventing sweating and frost on the accumulator tank, and prevents loss of coolant heat to the cold ambient that is typical during a heating mode of operation of the system.

While it is believed that the basics of the operation of the arrangement according to the invention are apparent from the foregoing description, the operation will now be summarized. Assuming a relatively hot ambient temperature in the cabinet containing the combined accumulator, receiver, and heat exchanger, warm liquid refrigerant passes from the condenser into the receiver 46. Assuming some degree of subcooling, it is desirable that the liquid refrigerant not be reheated to any significant degree in its passage to the evaporator. The hot liquid refrigerant passes from the receiver tank through the heat exchanger tube 58 carrying the external fins 60. At the same time, cold suction gas enters the accumulator tank after its passage from the evaporator, and this cold gas flows over the fins 60 of the heat exchanger 56 which tends to further cool the liquid refrigerant, while adding some heat to the cold refrigerant gas which then passes out of the accumulator at its upper end in its passage to the compressor.

I claim:

1. For a refrigeration unit including a refrigerant compressor, a refrigerant condenser having an inlet and outlet, and a refrigerant evaporator having an inlet and outlet, a combined liquid refrigerant receiver, refrigerant suction gas accumulator, and refrigerant heat exchanger, comprising:

an outer cylindrical shell serving as the accumulator and having a refrigerant gas inlet and a refrigerant gas outlet;

an inner cylindrical casing, concentrically disposed within said shell to provide an annular space therebetween, and serving as the liquid refrigerant receiver, said receiver having an inlet connected to said condenser outlet, and an outlet located internally of said shell; and a heat exchanger located in said annular space and having an inlet connected to said receiver outlet and an outlet in communication with said evaporator inlet.

2. The apparatus of claim 1 wherein:

said accumulator inlet and outlet are located, relative to said heat exchanger, to require the refrigerant gas passing therebetween to traverse said annular space containing said heat exchanger.

3. The apparatus of claim 2 wherein:

said heat exchanger comprises an externally finned tube helically wound about said receiver casing in said annular space.

4. The apparatus of claim 1 wherein:

said shell and said casing are disposed in an upright position with said casing located in the generally upper half portion of said shell, said refrigerant gas inlet is located at a level at least as low as that generally corresponding to the lower portion of said receiver casing, and said refrigerant gas outlet is located in the upper portion of said shell.

5. The apparatus of claim 4 wherein:

said receiver inlet includes means for directing the liquid refrigerant against the internal surface of said casing adjacent the upper end of said casing.

6. The apparatus of claim 4 wherein:

the top of said shell and said casing comprises a common member.

7. The apparatus of claim 4 including:

means for applying an external source of heat to the lower portion of said shell.

8. The apparatus of claim 7 including:

thermal insulation means encompassing at least the major portion of said shell sidewalls and the shell bottom wall.

* * * * *

UNITED STATES PATENT AND TRADEMARK OFFICE

CERTIFICATE OF CORRECTION

PATENT NO. : 4,537,045

DATED : August 27, 1985

INVENTOR(S) : DONALD K. MAYER

It is certified that error appears in the above-identified patent and that said Letters Patent is hereby corrected as shown below:

On the front data page, Item (73) "Assignee" should read as follows:

Thermo King Corporation
Minneapolis
Minnesota

Signed and Sealed this

*Twenty-sixth* Day of *August 1986*

[SEAL]

*Attest:*

DONALD J. QUIGG

*Attesting Officer*

*Commissioner of Patents and Trademarks*